United States Patent [19]

Kobayashi et al.

[11] Patent Number: 4,789,079

[45] Date of Patent: Dec. 6, 1988

[54] CARD DISPENSER

[75] Inventors: Osamu Kobayashi, Saitama; Hiroshi Hayashi, Sakado; Kenji Nakajima, Saitama, all of Japan

[73] Assignee: Nippon Coinco Co., Ltd., Tokyo, Japan

[21] Appl. No.: 98,608

[22] Filed: Sep. 18, 1987

[30] Foreign Application Priority Data

Sep. 20, 1986 [JP] Japan ..... 61-220977
Sep. 20, 1986 [JP] Japan ..... 61-220978

[51] Int. Cl.[4] ..... G07F 11/16

[52] U.S. Cl. ..... 221/232; 221/279; 271/143; 414/131

[58] Field of Search ..... 221/198, 227, 232, 279; 414/125, 129, 131; 271/143, 146, 139

[56] References Cited

U.S. PATENT DOCUMENTS 4,085,863 4/1978 Johnson ..... 221/20
4,209,108 6/1980 Winans ..... 221/232 X
4,603,792 8/1986 Molineux ..... 221/96

*Primary Examiner*—Michael S. Huppert
*Attorney, Agent, or Firm*—Bruce L. Adams; Van C. Wilks

[57] ABSTRACT

A card housing section has at a front surface a cut portion provided with an opening and closing portion and at a lower end an opening provided with a receiving rib, and a card is held between the receiving rib and a push-plate mounted on an upper plate of a housing box through a coil spring. A second supporting rod slidably and rotatably connected to a first supporting rod stood upright on the push-plate is held in the horizontal state on the housing box by the action of the coil spring, and cards may be supplied through the cut portion in the front of the housing box into a space formed between the push-plate and the receiving rib while the housing section is being assembled into a dispenser body. In addition, a card dispensing section comprises a guide hole extending in a direction of dispensing cards and having sliding grooves provided on opposite sides thereof and inlet and outlets which are downwardly opened into one place forward and backward, and a sliding rod reciprocably fitted in the guide hole. In dispensing cards, the sliding rod is brought into engagement with the sliding groove to be reciprocated in the horizontal state, and a card is pushed out by means of a push-out piece provided on the sliding rod, after which the end of the sliding rod is lowered through the forward inlet and outlet and is returned while maintaining the downwardly inclined state.

18 Claims, 12 Drawing Sheets

CARD DISPENSER

FIELD AND BACKGROUND OF THE INVENTION

The present invention relates to card dispensers, and more particularly to a card dispenser for use with prepaid cards such as telephone cards and railway tickets.

The present inventor has previously proposed a card dispenser comprising a housing section in which a housing box of a square shape in cross section whose lower end surface is opened and having a lower edge of a wall surface opposed at the open surface inwardly bended to provide a receiving rib is internally provided with a spring for biasing a card in a direction of the open end surface and a push plate; a dispensing section in which a cover plate mounted so as to cover the open end surface of the housing section is provided with a sliding rod which feeds one by one the lowermost card whenever so required among cards housed in the housing box upon reciprocating motion of the sliding rod; and a drive section which decelerates rotation of a drive motor to impart reciprocating motion to the sliding rod (Japanese Utility Model Application Laid-Open Nos. 61-168037 and 61-173400).

In the aforementioned prior card dispenser, the dispensing section is pivotally mounted on the lower end of the housing section so as to open and close the open surface of the lower end of the housing box. When cards are housed within the housing box, the housing section along with the dispensing section are removed out of the dispenser body, and thereafter the dispensing section and the housing section are disengaged from each other, and the dispensing section is rotated downwardly to open the open portion at the lower end of the housing box. Under this state, cards are supplied in a stacked fashion into the housing box from the lower open portion while pressing the push plate against the spring. Under this state, the lower open portion of the housing box is again closed by the dispensing section and then incorporated into the dispenser body. This structure has disadvantages in that operation of supplying cards to the housing box is cumbersome and handling is inconvenient.

Furthermore, in the dispensing section, the sliding rod is reciprocably mounted in a horizontal state on the cover body to cover the lower open portion of the card housing box constituting a housing section, and a push-out member formed, for example, of sintered metal is embedded in the intermediate portion of the sliding rod so that the surface of the sliding rod may be inflated. This structure has disadvantages in that in the process wherein the sliding rod moves forward so that the push-out member pushes out a card and then returns, the push-out member embedded in the sliding rod so that the surface thereof is inflated slidably contacts the surface of the new lowermost card to possibly damage said card, and in addition, the surface of the push-out member becomes worn to impair the adquate push-out function for cards.

SUMMARY OF THE INVENTION

It is therefore a primary object of the present invention to provide an arrangement in which cards may be supplied into a housing box under the state that a housing section is incorporated into a dispenser body, thereby overcoming the first disadvantages as described above with respect to prior art. In this embodiment, as will be described in detail in conjunction with the drawings, it comprises a housing box in which a main body portion of a housing section having at least a front surface cut in the form of an opening and a lower surface opened has an opening and closing portion for opening and closing said cut portion, and an inwardly directed receiving rib is provided on the opening at the lower end thereof; and a pressing mechanism in which a first support rod is stood upright on a push plate for holding a card with said receiving rib, a second support rod is connected thereto movably up and down and pivotably so that the upper end thereof may extend through the upper surface of the housing box, an upper member having a handle is mounted to the upper end of the second support rod, and a coil spring is provided between the push plate and the upper surface of the housing box. This arrangement has advantages in that cards may be supplied to the housing box without removing the housing section as experienced in prior art to provide an extremely convenient handling, and a space required for removing the housing section may be eliminated to obtain a freedom of a space where the apparatus of the present application is installed.

It is a further object of the present invention to provide an arrangement wherein in the dispensing operation for cards, the sliding rod is moved forward in a horizontal state, and after the cards have been fed out, the sliding rod is returned in a downwardly-directed inclined attitude thereby overcoming the aforementined second disadvantages with respect to the prior application. In this embodiment, a dispensing section comprises a guide hole having the size enough to cover the lower surface of a housing box constituting said housing section and extending in a direction of dispensing cards; a cover plate having a sliding groove in the side opposed to the guide hole and being provided before and behind the sliding groove with an inlet and outlet opened at the bottom; and a sliding rod provided at the front end thereof with a projection which is engaged and disengaged from the sliding groove through the inlet and outlet, engaged with the sliding groove when moving forward while coming into sliding contact with the lower surface of the cover plate when returning, and at the intermediate portion a push-out member embedded so that the surface thereof may be raised, said sliding rod being connected to a driven rod of the drive section so that the former may be downwardly inclined, further comprising a spring which, when the sliding rod is moved forward, acts on the rear end thereof to restore the sliding rod to its horizontal attitude. This arrangement has advantages in that when the sliding rod is moved foward, the push-out member will not sliding contact with the surface of the lowermost card housed in the housing box as experienced in prior art, and accordingly, the cards are not possibly damaged, and the surface of the push-out member is less worn, providing an increased durability.

The above and other objects and new features of this invention will be more completely apparent from reading of the ensuing detailed description in conjunction with the accompanying drawings. It is to be noted however that the drawings are merely for an explanation but not intended to limit the scope of the invention.

BRIEF DESCRIPTION OF THE DRAWINGS

Embodiments of the present invention are shown in the accompanying drawings in which.

DESCRIPTION OF THE PREFERRED EMBODIMENTS

Figure 1:
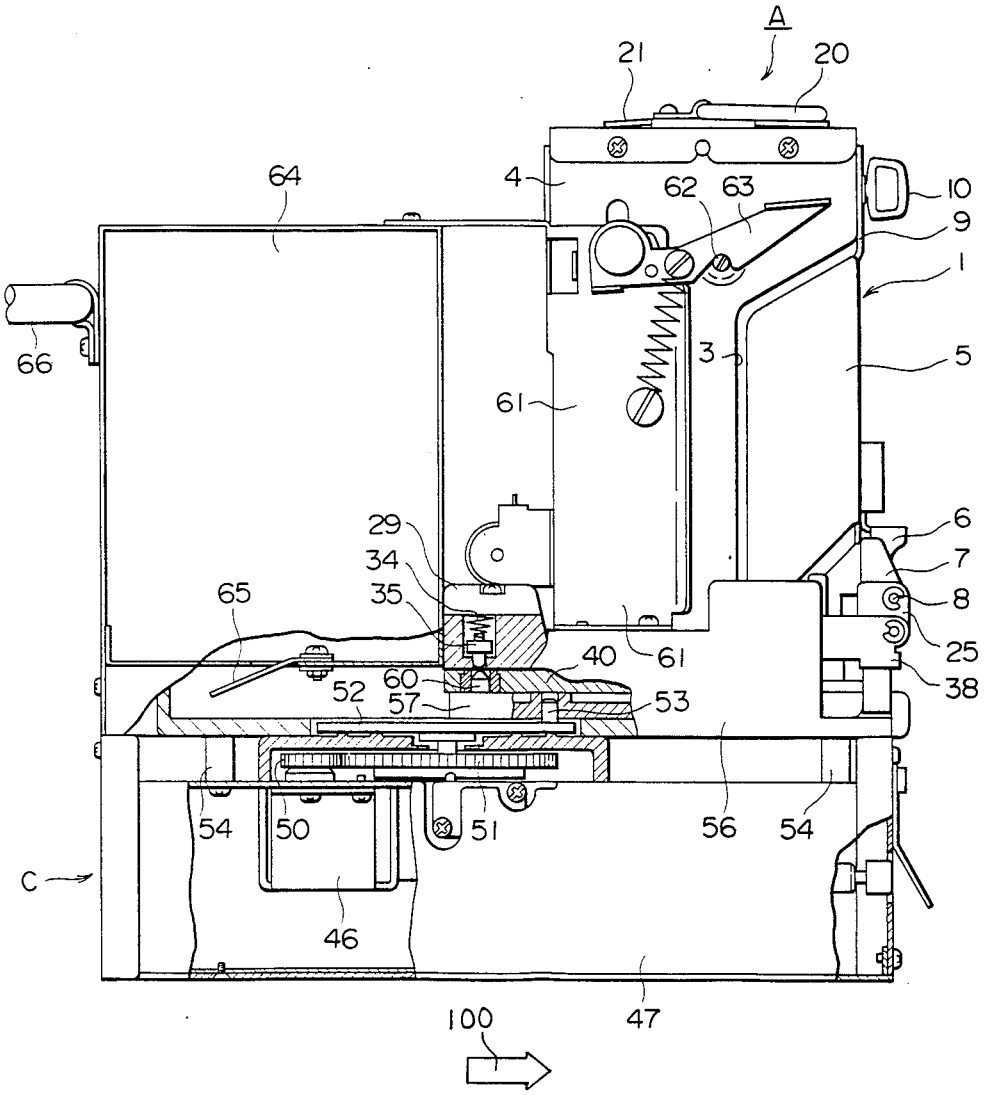
FIG. 1 is a partly cutaway left side view showing the whole device.

The embodiments of the present invention will be described hereinafter in connection with the drawings.

This card dispenser comprises a housing section A for housing cards and always resiliently biasing the cards downwardly, a dispensing section B (FIG. 3) for sequentially dispensing the lowermost card whenever so required among cards housed within the housing section A by forward and backward movement thereof, and a drive section C for actuating the dispensing section B. The arrow 100 noted throughout the drawings indicates the forward direction or forward portion in the description of the specification referring to the drawings.

Figure 10:
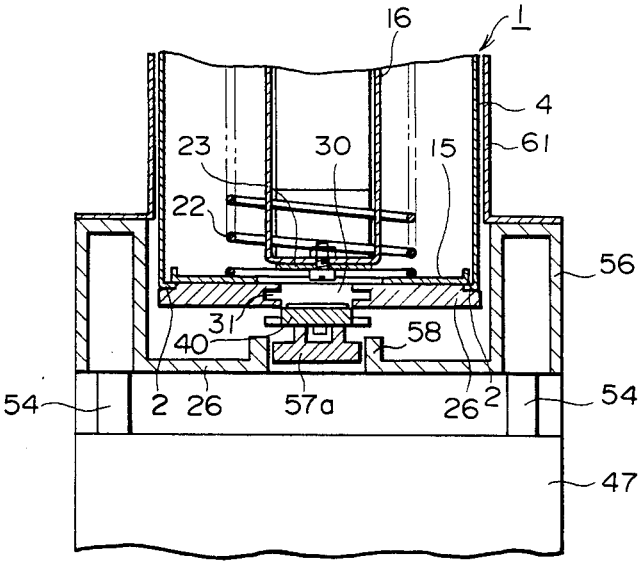
FIG. 10 is a fragmentary longitudinal sectional view.

The housing section A is of a square shape in cross section suitable for housing a number of cards in a stacked state and has a housing box 1 which extends longitudinally and is open at the lower surface thereof. This box 1 is composed of a main portion 4 having an inwardly bended receiving rib 2 (FIG. 10) at the lower edge opposed in a long side of an opening in the lower surface and having a cut portion 3 extending from the front surface (a card discharging side) to a left-right side half portion and with its left-right side downwardly inclined, and an opening and closing portion 5 in the shape of ⊐ in cross section integrally having a front plate and left and right side plates so as to close the cut portion 3. This opening and closing portion 5 is pivotably mounted on the main portion 4 by connecting a support 6 provided on the lower front surface of the front plate to a mounting portion 7 provided on the lower portion of the front surface of the main portion 4 through a pivot shaft 8. An abutting piece 9 is extended over the front plate, and an engaging piece 11 (FIGS. 2 and 6) rotated by a knob 10 provided on the abutting piece 9 is placed in engagement with an engaging hole 12 (FIGS. 6 and 7) provided in the upper portion of the front surface of the main portion 4 whereby the opening and closing portion 5 is mounted in a closed state with respect to the main portion 4.

The main portion is provided in its left-right side with a longitudinal slot 13 (FIGS. 3, 5, 7 and 8) so that a quantity of cards housed is visible. A card pressing mechanism 14 is provided within the thus structured housing box 1.

This card pressing mechanism 14 (FIGS. 6, 7 and 8) is composed of a square-shaped push plate 15 (FIGS. 3, 4, 6, 7, 8 and 10) received by a receiving rib 2 provided on an opening at the lower end of the housing box 1, a pair of left and right first supporting rods 16 extending upwardly from a central portion of a long side of the push plate 15, a pair of left and right second supporting rods 19 slidably connected by engagement of a slot 18 with a stop 17 (FIGS. 6, 7 and 8) provided on the upper end of the supporting rod 16, said second rods 19 extending upwardly and having the upper portion thereof extended through the upper surface of the main portion 4, an upper piece 21 mounted on the upper end of the second supporting rod 19, abutting against the upper surface of the main portion 4 and having a handle piece 20, a coil spring 22 (FIGS. 3, 4, 6, 7, 8 and 10) interposed between the upper surface of the main portion 4 and the push plate 15, and a supporting piece 23 for supporting both upper and lower ends of the coil spring 22 on both upper and lower surfaces, respectively, of the housing box 1.

The dispensing section B comprises a cover plate 26 which has the size enough to cover an opening at the lower end of the housing box 1 and is integrally provided forwardly with a pivot 25 (FIGS. 5 and 6) rotatably mounted on the mounting portion 7 through the pivot shaft 8, and at the rear of the cover plate 26 is mounted a box-like auxiliary member 29 (FIGS. 2, 4, 5 and 6) projectingly provided on the side with an engaging pin 28 in engagement with a pivotable engaging pawl 27 (FIG. 2) which is always vertically urged against the lower portion of the rear surface of the housing box 1.

The cover plate 26 is bored in a short-side central position with an elongated guide hole 30 which extends lengthwise and is open at the rear end. This guide hole 30 has a sliding groove 31 in the lengthwise opposed side thereof and is provided at the front end (left side in FIG. 2) and at the rear end with a first inlet and outlet **32*a* and a second inlet and outlet 32*b* in the form wherein a lower side forming the sliding groove 31 is cut off. The auxiliary member 29 provided at the rear of the cover plate 26 is formed in the lower surface thereof with an opening 33 so as to extend the guide hole 30, and is internally provided with a pin 35 with a collar which is always pressed by a spring 34 (FIGS. 1, 3, 4, 6, 7 and 8) and part of which fronts into the opening 33, said pin 35** being movable up and down.

On the front of the cover plate 26 is provided with a laterally extending gate 37 formed, for example, of sintered metal, which forms a slit 36 (FIGS. 3, 4, 7 and 8) which allows a passage of a single card between it and the upper surface of the cover plate 26, and a pivotable opening and closing member 38 (FIGS. 1 to 8) which extends laterally so as to cover the slit 36 by the front and which is automatically restored to its original attitude by a weak urging force.

Figure 12:
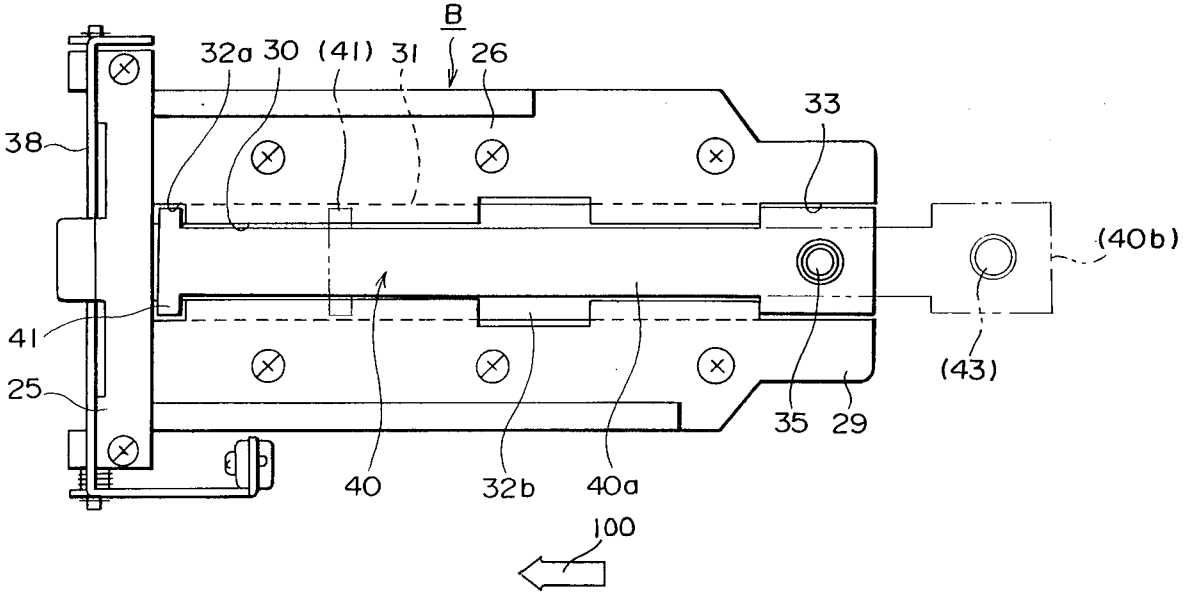
Figure 13:
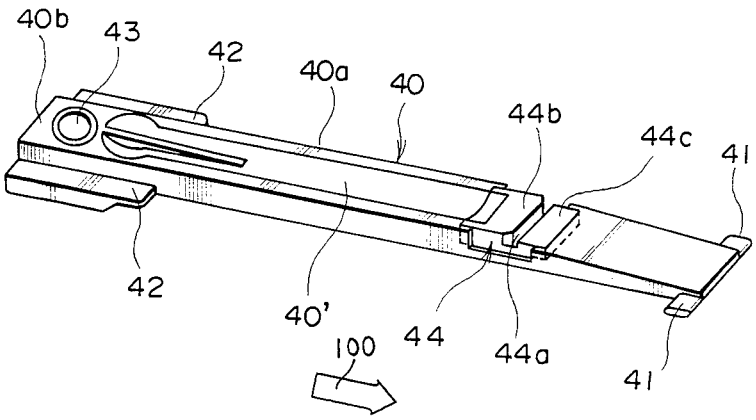
FIG. 13 is a perspective view of the sliding rod.

A lengthy sliding rod 40 (FIGS. 11 to 13) slidably mounted within the guide hole 30 is composed of a front portion **40*a* (right side in the figure) positioned in the guide hole 30 and a rear portion 40*b* (left side in the figure) positioned in the opening 33. The front portion 40*a* is provided at front and rear ends with a first projection 41 and a second projection 42, respectively, which project sideward from the lower half portion thicknesswise, and the rear portion 40*b* is provided with a hole 43 which increases in thickness toward the lower surface and has a metal sleeve embedded in the center thereof and engaging a pin 35 with a collar, said hole 43 extending through thicknesswise. The sliding rod 40 is further provided in its longitudinal intermediate portion a recess 44*a* which is formed of sintered metal in the form of a square in plane and extends perpendicular to the sliding direction of the sliding rod 40 in the upper intermediate portion, and a shoulder 44***b* equal to or slightly smaller than the thickness of a single card, and a push-out member 44 inclined at 44*c* of slightly forwardly of the forward upper surface (right side in the figure) is embedded so that the surface thereof may be raised slightly from the upper surface of the sliding rod 40.

Figure 9:
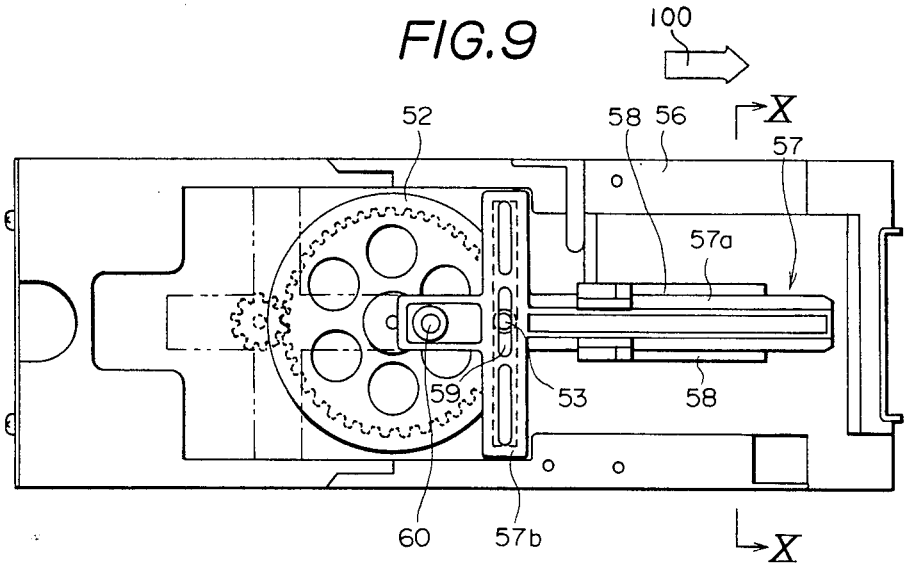
FIG. 9 is a plan view of a drive section.

The drive section C has a casing 47 internally provided with a drive motor (FIGS. 3 and 4) and a rotation transmission portion 46 (FIGS. 1, 3 and 4), and on the upper surface of the casing 47 are provided a reduction gear mechanism 48 (FIGS. 3 and 4) receiving rotation from the rotation transmission portion 46 and a conversion mechanism 49 (FIG. 3) for converting rotational motion from the reduction gear mechanism 48 into reciprocating motion. The reduction gear mechanism 48 is composed of a small-diameter gear 50 (FIGS. 1, 3 and 4) provided on an output shaft of the rotation transmission portion 46 for horizontal rotation, and a large-diameter gear 51 meshed with the small-diameter gear 50 for horizontal rotation; and the conversion mechanism 49 is composed of a rotating plate 52 which rotates along with the large-diameter gear 51 with a non-circular center shaft 52*a* (FIGS. 3, 4 and 9) fitted in a bearing portion having a non-circular center hole formed in the center of the large-diameter gear 51 and which has an eccentric shaft 53 (FIGS. 1, 3, 4 and 9) projected on the upper surface thereof, and a driven rod 57 (FIGS. 1, 3, 4 and 9) in the form of a cross which is secured to the upper surface of the casing 17 through a spacer 54 (FIGS. 1–4 and 10) and which is reciprocably supported on the upper surface of an intermediate member 56 (FIGS. 2–4, 9 and 10) having an opening 55 (FIGS. 3 and 4) with the rotating plate 52 exposed. A longitudinal piece 57*a* (FIGS. 9 and 10) extending longitudinally of the driven rod 57 is longitudinally slidably supported by a guide piece 58 integrally provided on the upper surface of the intermediate member 56, and a cross piece 57*b* (FIG. 9) perpendicular thereto is formed at the lower surface with an engaging groove 59 in sliding engagement with the eccentric shaft 53 of the rotating plate 52. A fitting shaft 60 formed of metal is provided on the rear end of the longitudinal piece 57*a*, said fitting shaft 60 being engaged with the engaging hole 43 of the sliding rod 40 in the dispensing section B. The intermediate member 56 has its front portion formed into a recess and support plates 61 (FIG. 10) stood upright on the opposite sides thereof so that the housing section A may be fitted and retained. The upper side of the support plate 61 is provided with an engaging piece 63 (FIG. 1) which engages an engaging pin (FIGS. 1 and 5) provided on the upper end of the housing section A arranged on the upper surface of the intermediate member 56 to retain the housing section A. Reference numeral 64 (FIGS. 1, 3 and 4) designates a control section secured in an erected mode to the rear position of the intermediate member 56; 65, a depressing spring provided on the lower surface forwardly of the control section 64; and 66 (FIGS. 1 and 2), a power source cord.

Then, the housing section A integrally provided at the lower surface with the dispensing section B is assembled into the forward-upper position of the drive section C, the sliding rod 40 is placed on the longitudinal piece 57*a* of the driven rod 57, and the fitting shaft 60 is fitted into the engaging hole 43. In this state, the engagement between the engaging hole 43 and the pin 35 with a collar is released by the upper end of the fitting shaft 60, and the sliding rod 40 is placed on the longitudinal piece 57*a* slightly vertically tiltably since the rear portion 40*b* thereof is thick.

Figure 2:
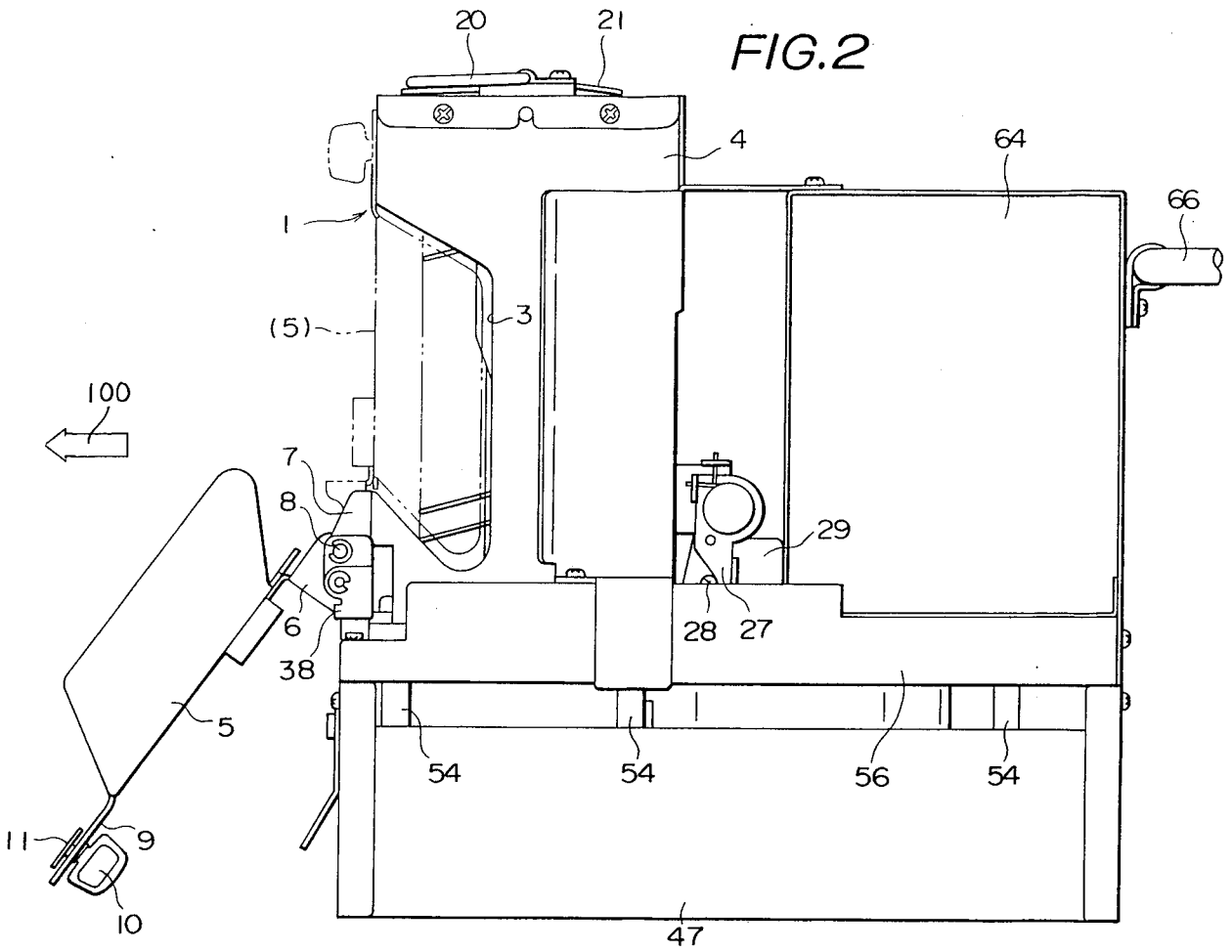
FIG. 2 is a right side view of the whole device with an opening and closing portion opened.

This state is shown in FIGS. 1 and 2. When cards P (FIGS. 3, 4 and 8) are taken into the housing section A from the aforesaid state, the knob 10 is turned thereby disengaging the engaging piece 11 from the engaging hole 12 to fall the opening and closing portion 5 outwardly as shown in FIG. 2 and open the cut portion 3 of the housing box 1. For brevity of the drawings, FIGS. 5 to 8 show the state in which the housing section A as well as the dispensing section B is removed from the drive section C. The operation will now be described in detail referring to FIGS. 5 to 8.

Figure 6:
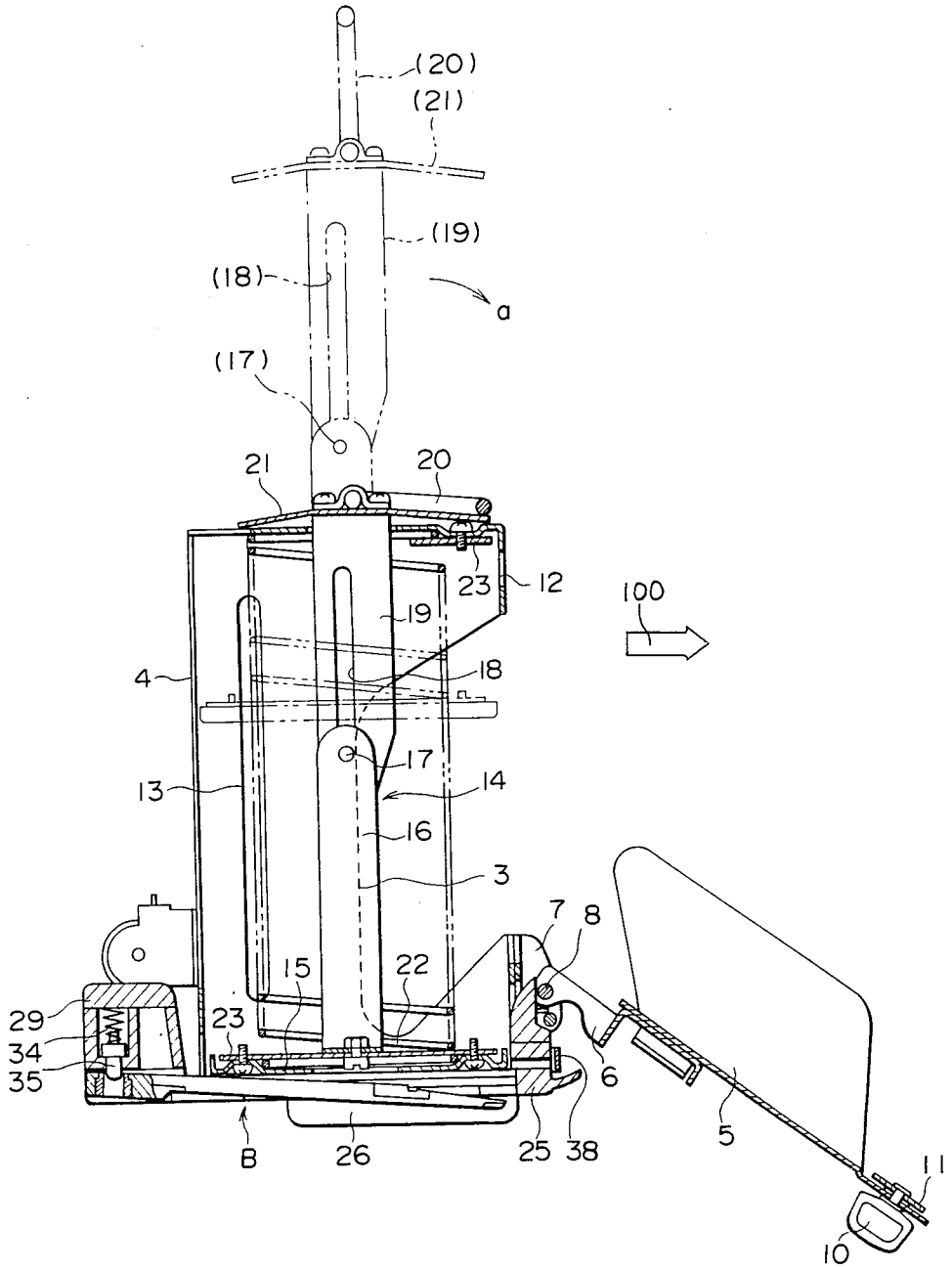
FIGS. 6,7 and 8 are respectively side sectional views showing the operating state of a pressing mechanism.
Figure 7:
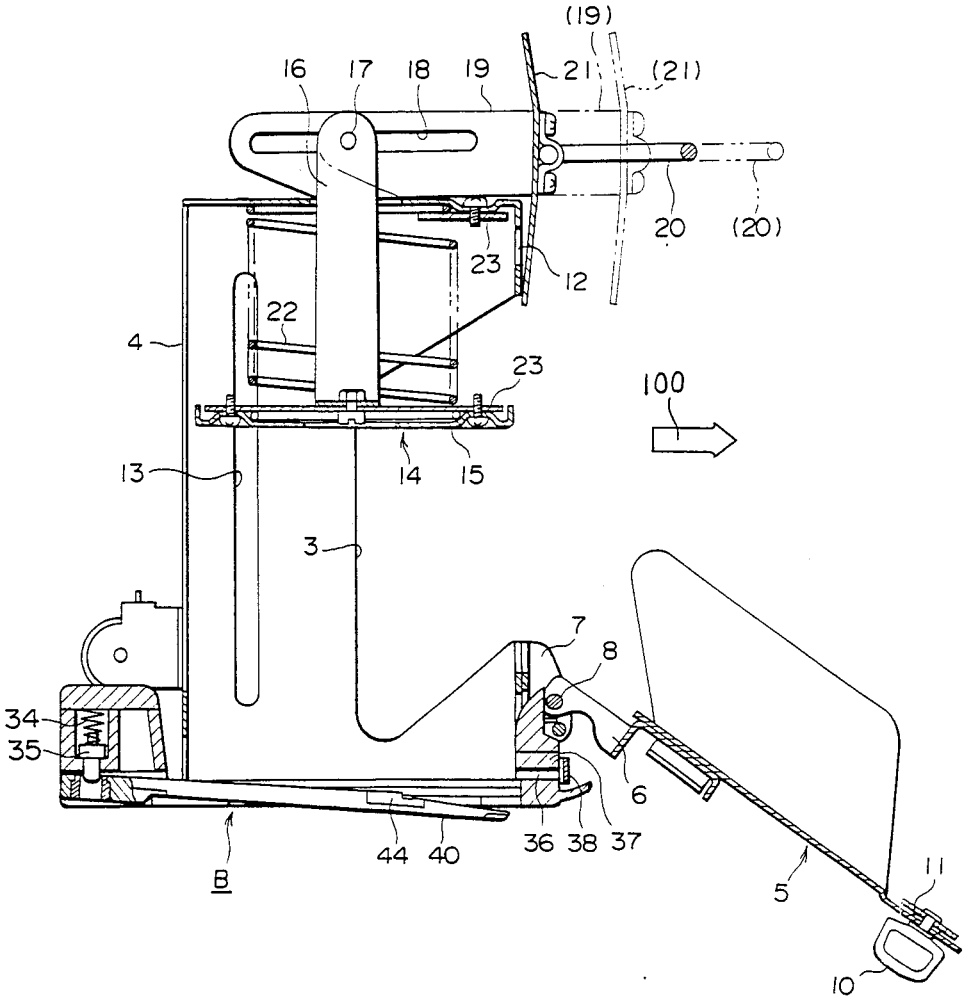

In the state shown by the solid line in FIG. 6 in which the cut portion is opened, the handle 20 is fully pulled upwardly against the coil spring 22 so that the lower end of the second supporting rod 19 is disengaged from the upper surface of the main portion 4 as shown by the phantom line in the figure, after which the handle 20 is pulled down in the direction as indicated by arrow a in the state wherein the handle 20 is pulled. Then, the second supporting rod 19 rotates in the same direction about the stop 17 as indicated by the phantom line in FIG. 7 and is fallen in the horizontal state, from which state the second supporting rod 19 is pulled out forwardly so that the upper piece 21 is brought into abutment with the front surface of the main portion 4 as indicated by the solid line. In this state, the approximately intermediate portion lengthwise of the second supporting rod 19 is downwardly biased by the coil spring 22 and the first supporting rod 16, and the fallen state of the second supporting rod 19 is maintained, and there is formed a large space between the push plate 15 and the receiving rib 2. The cards P are supplied from the front of the housing box 1 into the aforesaid space through the cut portion 3.

Next, after the cards P have been housed in a stacked fashion within the main portion 4, the opening and closing portion 5 is stood upright, and the knob 10 is turned to bring the engaging piece 11 into engagement with the engaging hole 12 to close the cut portion 3. Then, conversely of the former, the handle 20 is pulled this side to assume the state as indicated by the phantom line in FIG. 7 from the solid-line state of the same figure, and further the second supporting rod 19 is stood upright as indicated by the phantom line in FIG. 6.

Figure 8:
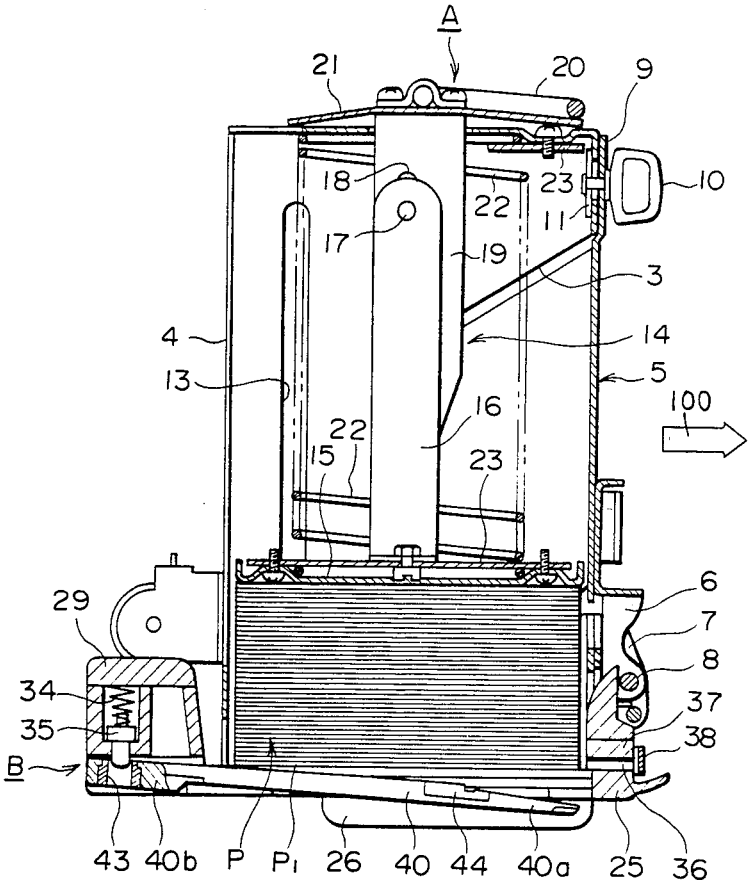

Then, the second supporting rod 19 hangs down due to its own weight by the engagement between the stop 17 and the slot 18, and the housed cards P are held between the push plate 15 and the receiving rib 2 by the biasing force of the coil spring 22 as shown in FIG. 8.

Figure 3:
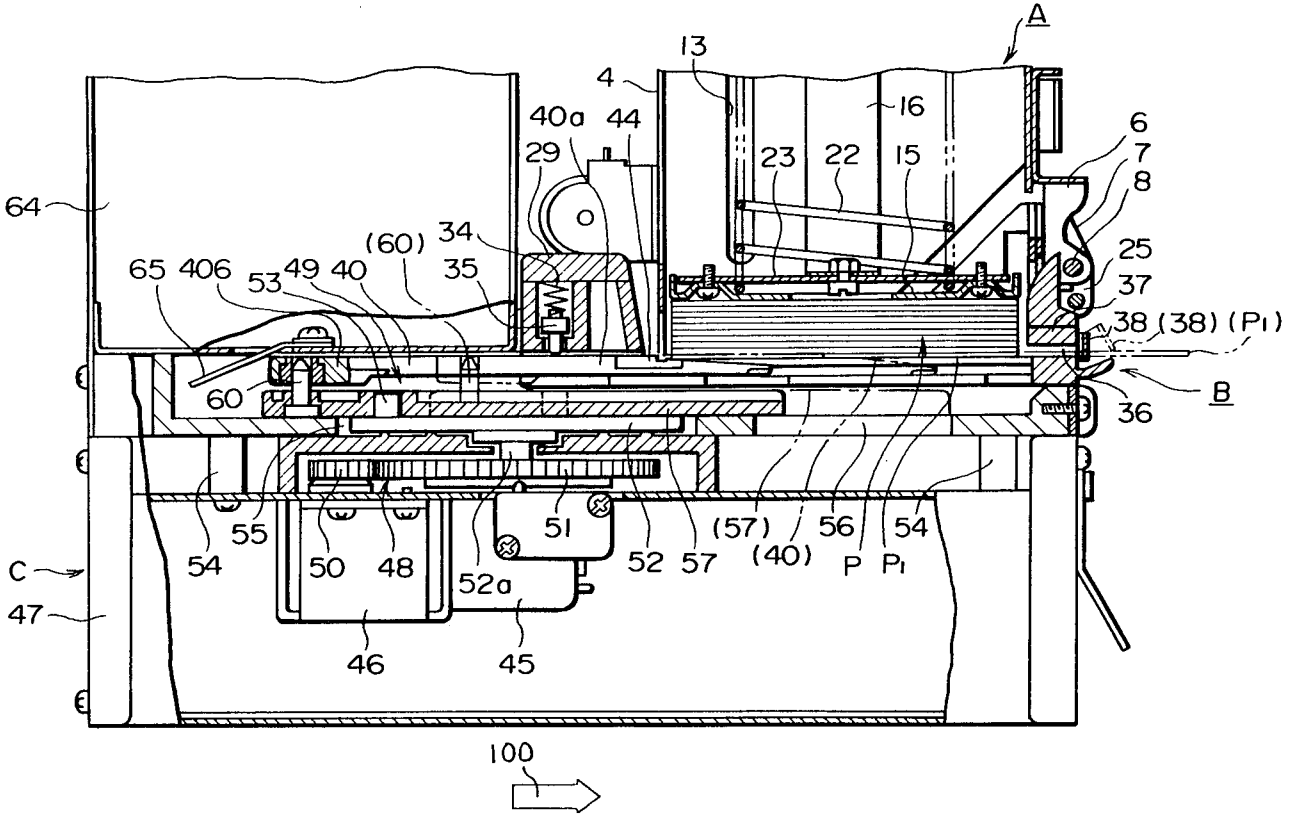
FIGS. 3 and 4 are respectively fragmentary sectional views showing the operating state.
Figure 4:
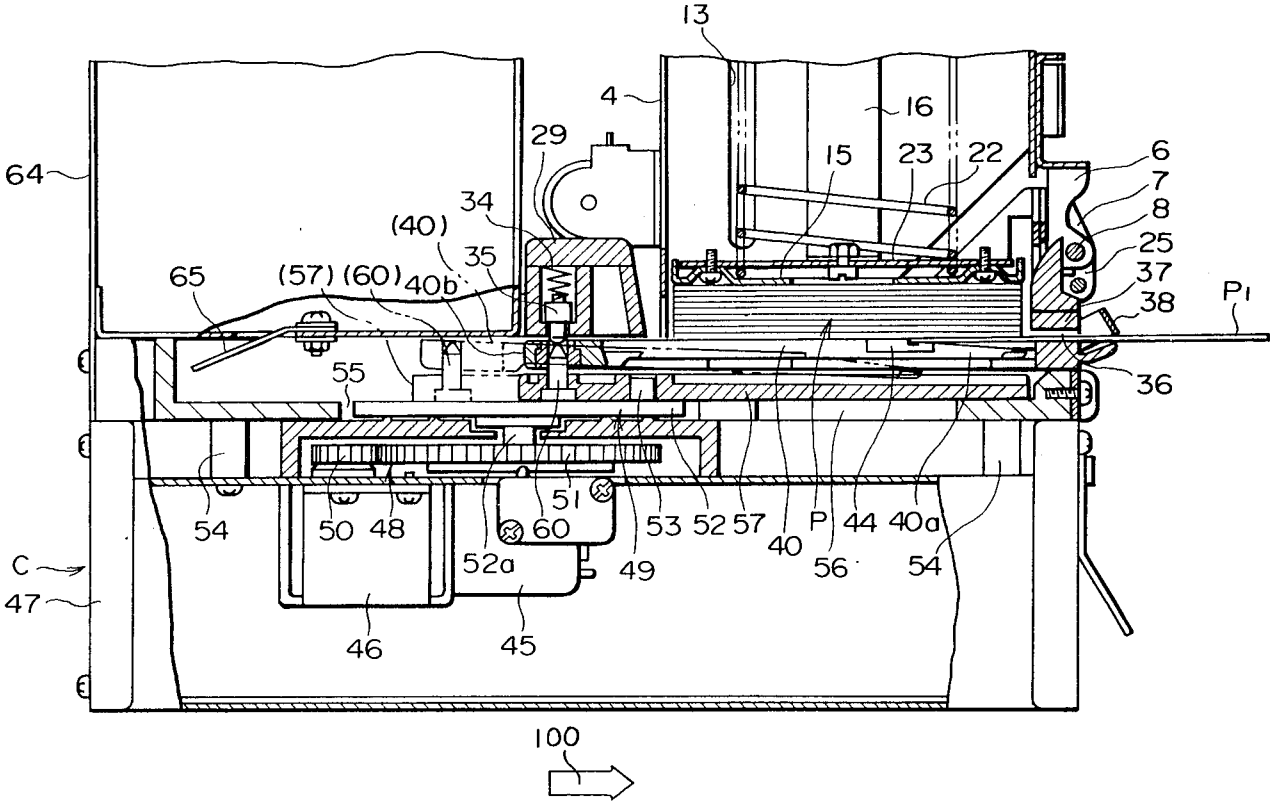

FIG. 3 shows the state in which the cards P are housed in a stacked fashion within the housing section A, and the sliding rod 40 in the dispensing section B has moved to the rearmost position. In this state, when the drive motor 45 is run through the control section 64 according to the command signal, the rotating plate 52 is rotated through the reduction gear mechanism 48. Upon every rotation, the driven rod 57 takes one reciprocating movement in a lateral direction through the engagement thereof with the eccentric shaft 53, and the sliding rod 40 also takes one reciprocating movement in a lateral direction through the engagement between the fitting shaft 60 and the fitting hole 43. That is, as shown by the solid line in FIG. 3, the retracted sliding rod 40 moves forward, and this forward movement causes the shoulder 44*b* formed on the push-out piece 44 to engage the rear edge of the lowermost card P1 to urge the latter forward. At that time, the card P1 will not be floated up by the formation of the aforesaid inclined surface 44a, and the dust adhered to the cards or the like falls into the recess 44c. Therefore, an erroneous operation such as unauthorized dispensation of cards will not possibly occur. The pushed-out card P1 is forced forward through the slit 36, and at that time, even if the lowermost card P1 together with the card laid directly thereabove are moved forward together due to the electrostatic action, the cards are prevented from their forward movement at the position of the slit 36.

When the card P1 is pushed out, the opening and closing member 38 is pressed by the front edge of the card P1 and turns outwardly, and when the card P1 is pulled out, it restores to its original position to close the slit 36.

During the reciprocating movement of the sliding rod 40, the pin 35 with a collar rolls along the longitudinally extending recess 40 provided in the upper surface of the sliding rod 40.

In the above-described arrangement, if the sliding rod 40 simply takes a reciprocating movement in a horizontal state and when the push-out piece 44 returns, it slidably moves along the surface of the lowermost card. Therefore, the card itself not only becomes possibly damaged but the surface of the push-out piece 44 also becomes worn, failing to provide a durability. Malfunction possibly occurs.

While, in the arrangement of the embodiment according to the present application, when the sliding rod 40 at the most backward position moves forward to dispense the card, it moves forward in a horizontal state. After the card has been dispensed and the rod has assumed its most forward position, the front portion of the sliding rod 40 is slightly depressed and inclined. And in this state, when the rod returns to assume its most backward position, the rear end thereof is slightly depressed so as to restore the sliding rod 40 to its horizontal state, thereby improving the aforesaid possibility.

Figure 11:
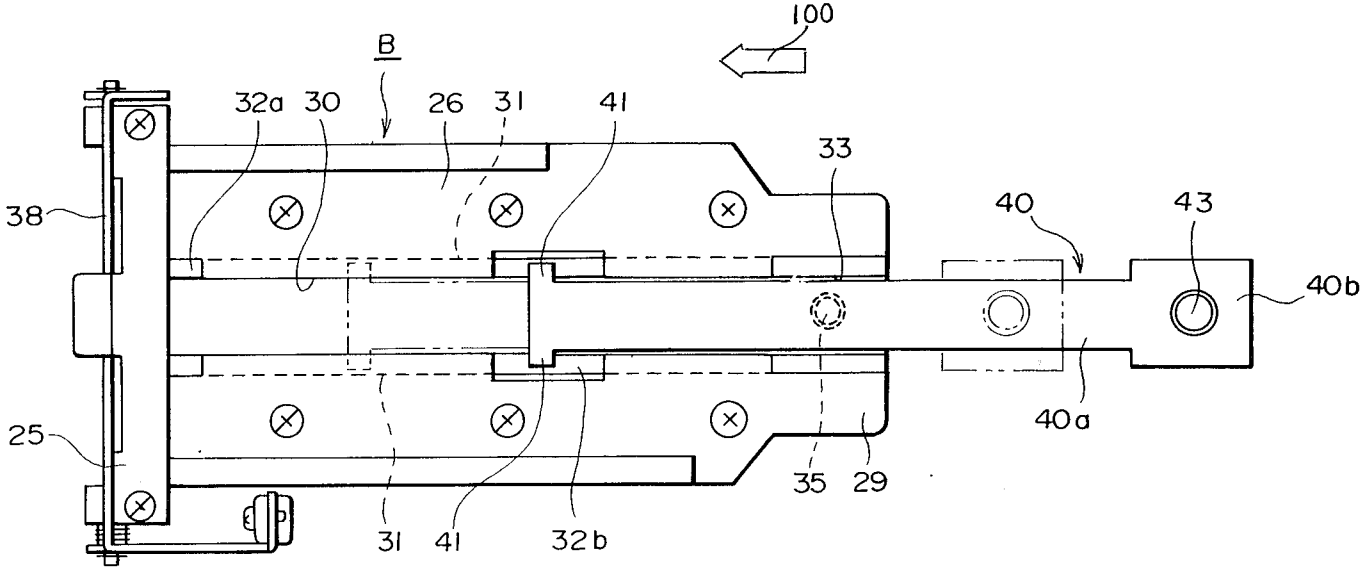
FIGS. 11 and 12 are respectively bottom views of a dispensing section showing the operating state of a sliding rod.

More specifically, when the sliding rod 40 is at the most backward position (indicated by the solid line) as shown in FIG. 11, the rear portion 40b of the sliding rod 40 is urged by the spring 65 as shown in FIG. 3 and the first projection 41 comes into abutment with the inner surface of the upper side of the sliding groove 31. In this state, the rod moves forward along with the driven rod 57, and during this forward movement, the first and second projections 41 and 42 are guided by the sliding groove 31 so that they maintain their horizontal state. Then, when the sliding rod 40 assumes the most forward state, the first projection 41 assumes the position of the first inlet and outlet 32a as shown by the solid line in FIG. 12. Therefore, the front end of the sliding rod 40 slightly moves down due to its own weight and the first projection 41 is disengaged from the sliding groove 31. Accordingly, the sliding rod 40 moves backward in a downwardly-directed inclined state while the first projection 41 is kept in contact with the lower surface of the cover plate 26 as shown by the phantom line in FIG. 12. Therefore, the push-out piece 44 is moved backward in the state in which the push-out piece 41 is disengaged from the lowermost card encased in the housing box 1 as indicated by the phantom line in FIG. 4. In the state in which the sliding rod 40 is fully moved backward, the first projection 41 is positioned at the second inlet and outlet 32b as shown by the solid line in FIG. 11 and is depressed by the spring 65 of the rear portion 40b. Therefore, the sliding rod 40 is restored to the horizontal state and the first projection 41 enters the second inlet and outlet 32b to assume the position on an extension of the sliding groove 31. Next, the sliding rod 40 again moves forward in the horizontal state from the aforesaid state.

In repair and inspection of the sections from the housing section A to the dispensing section B, when the engaging pin 62 is disengaged from the engaging piece 63, the housing section A as well as the dispensing section B may be removed from the top frontwardly of the drive section C.

In this case, since the fitting shaft 60 is disengaged from the engaging hole 43, the sliding rod 40 is possibly slipped out of the guide hole 29 and disengaged from the cover plate 26 during the handling of the housing section A and the dispensing section B. However, according to the embodiment of the invention, the pin 35 with a collar engages the engaging hole 43 in place of the disengagement of the fitting shaft 60, and therefore the disengagement of the sliding rod 40 is prevented.

Figure 5:
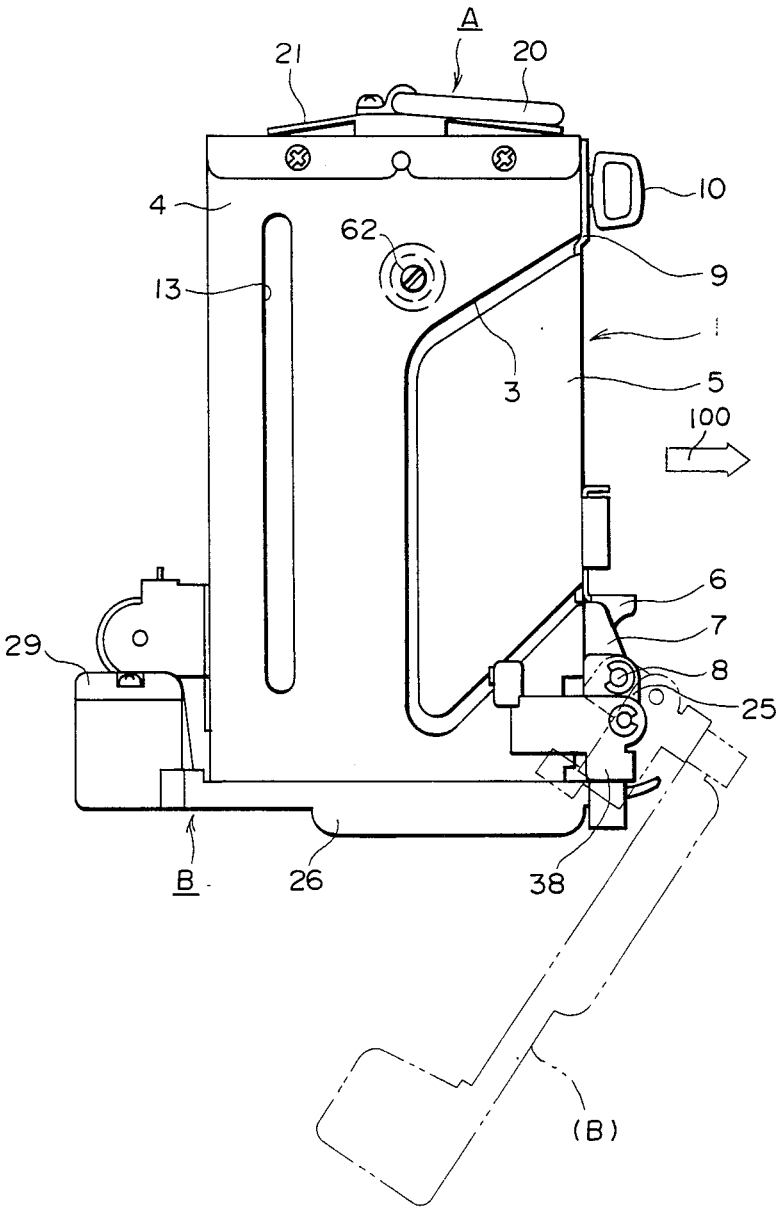
FIG. 5 is a side view showing a housing section and a dispensing section.

Also, in the state shown in FIG. 5, when the engagement between the engaging pin 28 and the engaging pawl 27 is released, the dispensing section B downwardly rotates about the pivot shaft 8 as indicated by the phantom line in FIG. 5.

While the present invention has been shown and described in connection with specific embodiments, it will be apparent for those skilled in the art that various changes may be made in shapes and details without departing from the subject matter and scope of the present invention.

What is claimed is:

1. A card dispenser comprising: a housing section for housing cards, a dispensing section for dispensing the lowermost card, one by one, among cards housed in the housing section, by a push-out piece provided on a reciprocably movable sliding rod, and a drive section provided with a driven rod connected to said sliding rod in said dispensing section to reciprocate the sliding rod through said driven rod according to a command signal, said housing section comprising a card housing box having a main body portion having at least an open cut portion at a front portion thereof and whose lower surface comprises an open end, an opening and closing member for opening and closing said cut portion mounted on said main body portion, and a receiving rib provided internally of said lower opening;

a push-plate which is present within said housing box to hold a card between it and said receiving rib; and a pressing mechanism provided with a resilient member mounted between said push-plate and the upper surface of said housing box;

said push-plate having a first supporting rod stood upright, said first supporting rod having a second supporting rod movably and pivotably connected thereto so that the upper end thereof may extend through the upper surface of said housing box, said second supporting rod having at the upper end thereof an upper piece provided with a handle;

said dispensing section comprising a cover plate having the size enough to cover the lower surface of said housing box and including a guide hole extending in a direction of dispensing cards, a sliding groove on the side opposed to said guide hole, and inlet and outlets which are downwardly opened at positions before and behind said sliding groove;

said sliding rod reciprocably fitted in said guide groove, said sliding rod having at a front end a projection which may be engaged with and disengaged from said sliding groove through said inlet and outlets and which engages said sliding groove when moving forward while being disengaged from said sliding groove when returning into sliding contact with the lower surface of said cover plate, and at an intermediate portion a push-out piece so that the surface thereof may be raised; and a shaft for connecting said sliding rod to said driven rod in said drive section so that the former may be downwardly inclined, and means acting on the rear end of said sliding rod when said sliding rod moves forward to restore said sliding rod to its horizontal state.

2. A card dispenser according to claim 1, wherein said housing box is rotatably provided, at the lower part of the main body portion formed with a cut portion from the front to the left-right side half, with an opening and closing portion for opening and closing said cut portion.

3. A card dispenser according to claim 2, wherein said housing box comprises a receiving rib which is of a square shape in cross section and in which a lower end of an opposed long side is inwardly bended.

4. A card dispenser according to claim 2, wherein said push-plate is of a square shape, a first supporting rod is stood upright in each central portion of the long side of said push-plate, a second supporting rod is connected to each said first supporting rod, and an upper piece is provided between the upper ends of said pair of second supporting rods.

5. A card dispenser according to claim 2, wherein said pressing mechanism comprises a resilient member composed of a coil spring whose upper and lower ends are fixed by said push-plate and the upper surface of said housing box, respectively.

6. A card dispenser according to claim 3, wherein said push-plate is of a square shape, a first supporting rod is stood upright in each central portion of a long side of said push-plate, a second supporting rod is connected to each said first supporting rod, and an upper piece is provided between the upper ends of said pair of second supporting rods.

7. A card dispenser according to claim 3, wherein said pressing mechanism comprises a resilient member composed of a coil spring whose upper and lower ends are fixed by said push-plate and the upper surface of said housing box, respectively.

8. A card dispenser according to claim 4, wherein said pressing mechanism comprises a resilient member composed of a coil spring whose upper and lower ends are fixed by said push-plate and the upper surface of said housing box, respectively.

9. A card dispenser according to claim 1, wherein said dispensing section is downwardly pivotably mounted on the housing section.

10. A card dispenser according to claim 1, wherein said sliding rod has a lower portion at the rear end thereof formed to have a thick-wall, said sliding rod having its lower surface placed on said driven rod, and said sliding rod is provided at the rear end thereof with an engaging hole into which is fitted a fitting rod projected on said driven rod.

11. A card dispenser according to claim 1, wherein said sliding rod has said projection provided on the lower half in the thick-wall direction thereof.

12. A card dispenser according to claim 10, wherein said sliding rod further has said projection provided on the lower half in the thick-wall direction thereof.

13. A card dispenser according to claim 1, wherein said sliding rod comprises a push-out piece formed of sintered metal.

14. A card dispenser according to claim 1, wherein said acting means comprises a resilient member.

15. A card dispenser according to claim 1, wherein said acting means comprises a spring.

16. A card dispenser according to claim 12, wherein said acting means comprises a resilient member.

17. A card dispenser comprising: a housing section for housing cards, a dispensing section for dispensing the lowermost card, one by one, by a push-out piece provided on a reciprocable sliding rod, and a drive section for reciprocating said sliding rod in the dispensing section according to a command signal, said housing section comprising a card housing box having a main body portion having at least an open cut portion at a front portion thereof and whose lower surface comprises an open end, an opening and closing member for opening and closing said cut portion mounted on said main body portion, and a receiving rib provided internally of said lower opening;

a push-plate which is present within said housing box to hold a card between it and said receiving rib; and a pressing mechanism provided with a resilient member mounted between said push-plate and the upper surface of said housing box;

said push-plate having a first supporting rod stood upright, said first supporting rod having a second supporting rod vertically movably and pivotably connected thereto so that the upper end thereof may extend through the upper surface of said housing box, said second supporting rod having at the upper end thereof an upper piece provided with a handle.

18. A card dispenser comprising: a housing section provided with a housing box for housing cards, a dispensing section for dispensing the lowermost card, one by one, among cards housed in said housing section, by a push-out piece provided on a reciprocable sliding rod, and a drive section provided with a driven rod connected to said sliding rod in said dispensing section to reciprocate the sliding rod through said driven rod according to a command signal, said dispensing section comprising a cover plate having the size enough to cover the lower surface of said housing box and including a guide hole extending in a direction of dispensing cards, a sliding groove on the side opposed to said guide hole, and inlet and outlets which are downwardly opened at positions before and behind said sliding groove;

a sliding rod reciprocably fitted in said guide groove, said sliding rod having at a front end a projection which may be engaged with and disengaged from said sliding groove through said inlet and outlets and which engages said sliding groove when moving forward while being disengaged from said sliding groove when returning into sliding contact with the lower surface of said cover plate, and at an intermediate portion a push-out piece so that the surface thereof may be raised; and a shaft for connecting said sliding rod to said driven rod in said drive section so that the former may be downwardly inclined, and means acting on the rear end of said sliding rod when said sliding rod moves forward to restore said sliding rod to its horizontal state.

* * * * *